US007415845B1

(12) United States Patent
Graichen

(10) Patent No.: US 7,415,845 B1
(45) Date of Patent: Aug. 26, 2008

(54) WINDOW SHADE

(76) Inventor: Claus Graichen, 3203 Cameron Dr., Henderson, NC (US) 27356

( * ) Notice: Subject to any disclaimer, the term of this patent is extended or adjusted under 35 U.S.C. 154(b) by 0 days.

(21) Appl. No.: 11/781,004

(22) Filed: Jul. 20, 2007

(51) Int. Cl.
*D04B 1/22* (2006.01)

(52) U.S. Cl. ..... 66/170

(58) Field of Classification Search ..... 66/190, 66/191, 192, 193, 195, 196, 169 R, 170, 202
See application file for complete search history.

(56) References Cited

U.S. PATENT DOCUMENTS 2,371,039 A * 3/1945 Fischel ..... 160/385
2,416,438 A * 2/1947 Fischel ..... 160/386
4,188,430 A * 2/1980 DeBernard et al. ..... 428/88
4,218,217 A * 8/1980 Redd, Jr. ..... 8/478
4,377,195 A * 3/1983 Weil ..... 66/195
5,385,036 A * 1/1995 Spillane et al. ..... 66/87
5,476,518 A * 12/1995 Caleshu ..... 8/115.69
5,791,392 A * 8/1998 Fernandez Lopez ..... 160/238
6,105,401 A * 8/2000 Chadeyron et al. ..... 66/195
6,199,410 B1 * 3/2001 Rock et al. ..... 66/195
6,212,913 B1 * 4/2001 Weiss ..... 66/172 R
6,644,070 B2 * 11/2003 Ikenaga et al. ..... 66/196
6,755,052 B1 * 6/2004 Sytz ..... 66/196
7,150,305 B2 * 12/2006 Yaw ..... 160/84.04
7,240,522 B2 * 7/2007 Kondou et al. ..... 66/195

* cited by examiner

*Primary Examiner*—Danny Worrell
(74) *Attorney, Agent, or Firm*—Coats & Bennett, P.L.L.C.

(57) ABSTRACT

A non-laminated window shade having simultaneously formed and interconnected layers is provided. Pattern is produced by revealing portions of an intermediate layer. An intermediate layer comprises solution dyed yarns of a dark color. Pad dyeing and yarn selection produces contrast between a front layer and revealed portions of an intermediate layer.

12 Claims, 4 Drawing Sheets

WINDOW SHADE

FIELD OF THE INVENTION

This disclosure related to the field of window treatments for controlling light and visibility.

BACKGROUND

Window treatments are used for controlling light and visibility as well as to provide aesthetic appeal. Many forms of window treatments are in use. These forms include curtains, roller shades, roman shades, and blinds. Typically, the dual roles of aesthetic appeal and light or visibility control requires fabrics composed of layers laminated together wherein one or more layers serves principally to limit light transmission while one or more layers serve principally to provide aesthetic appeal.

Lamination is a separate manufacturing step which must occur following forming the layers. Additional cost and time in manufacturing is required. Additionally, cutting alternatives allowable with laminated fabrics are limited and do not generally, for example, include laser cutting. Further, problems with de-lamination may limit the life span of laminated shade materials.

There is a need for a room darkening or dimming window treatment which overcomes the disadvantages of laminated fabrics.

SUMMARY OF THE INVENTION

A window treatment for room darkening or dimming is provided. The window treatment comprises a non-laminated window shade having integrally knitted front, back, and intermediate fabric layers. The front fabric layer is formed primarily by a first set of yarns. A second set of yarns primarily forms the back fabric layer. The intermediate fabric layer is formed primarily by a third set of yarns, and the intermediate layer substantially limits the transmission of light through the non-laminated window shade.

A method of forming a non-laminated window shade is also provided. The method includes selecting first, second, and third sets of yarns and simultaneously knitting and connecting the first, second, and third sets of yarns to form front, back, and intermediate fabric layers. The front, back, and intermediate fabric layers form the non-laminated window shade.

Other objects and advantages of the present invention will become apparent and obvious from a study of the following description and the accompanying drawings which are merely illustrative of such invention.

DETAILED DESCRIPTION

Figure 1:
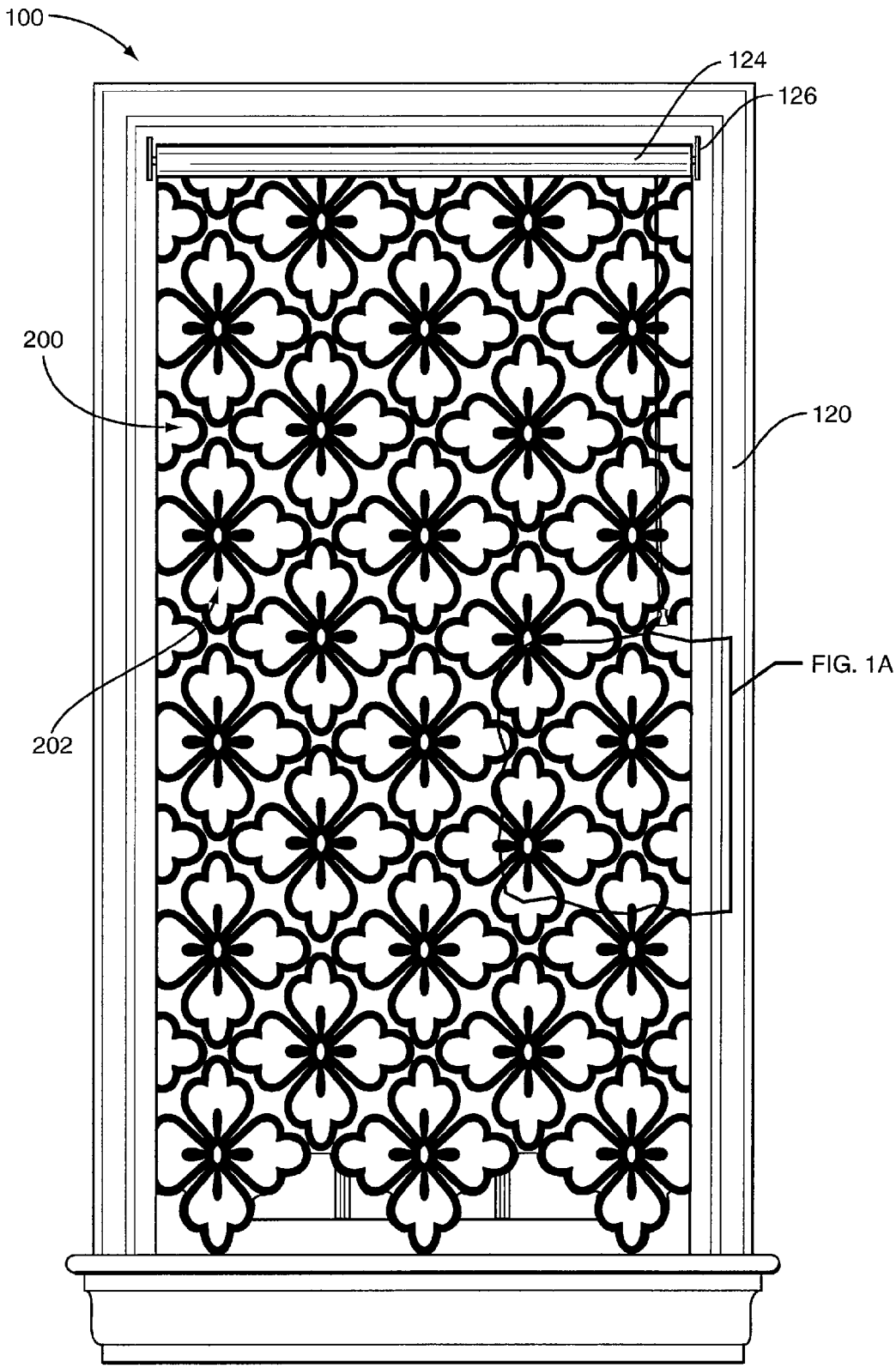
FIG. 1 is a front elevation view of a window treatment comprising a roller shade using the non-laminated window shade.
Figure 1A:
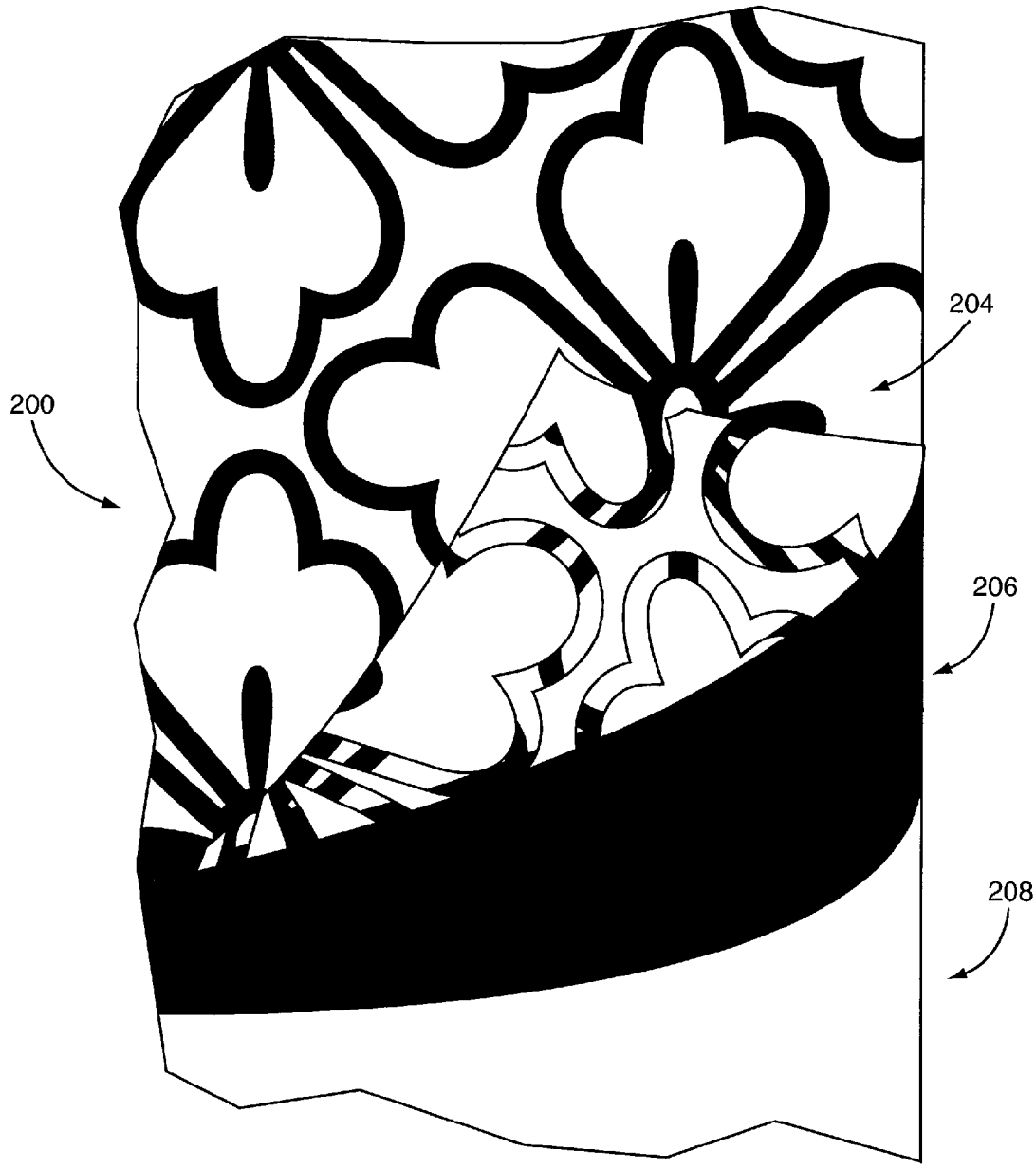
FIG. 1A is a fragmentary perspective of a portion of the window shade of FIG. 1 with the layers partially peeled apart.

With further reference to the drawings, the window treatment of the present invention is shown therein and indicated generally by the numeral 100. Window treatment 100 comprises a non-laminated window shade 200 that may be utilized in various ways. For example, as shown in FIG. 1, window shade 200 may be configured as a roller shade supported by brackets 126 and roller 124. Other examples of treatments into which window shade 200 may be configured include roman shades and blinds. Window shade 200 includes a front layer 204, an intermediate layer 206, and a back layer 208 as illustrated in FIG. 1A. A room darkening or room dimming effect is provided by window shade 200 due to a limiting of the transmission of light through the shade by one or more of the layers 204, 206, 208. Further, a pattern 202 may be visible when viewing window shade 200. Pattern 202 is formed by configuring front layer 202 such that portions of intermediate layer 206 are exposed or revealed to form the pattern. That is, as can be seen in FIG. 1A, openings are formed in front layer 204 to form pattern 202. This is an example negative patterning wherein portions of top layer 204 are removed or moved so as to reveal portions of intermediate layer 206. A textural, color, or shade contrast between top layer 204 and intermediate layer 206 gives rise to pattern 202.

Pattern 202 may be of various aesthetic forms such as portions of plants, geometric designs, etc. The forms comprising pattern 202 may be similarly shaped and distributed more or less uniformly across window shade 200. The forms may alternatively be variously shaped and grouped in various ways on window shade 200 depending on the artistic appearance being shown as well as the degree of room darkening or dimming being provided.

Turning now to a general description of non-laminated window shade 200, the shade comprises first, second and third sets of yarns forming generally the front layer 204, back layer 208, and intermediate layer 206, respectively. Additionally, non-laminated shade 200 includes a set of connecting yarns which connect the layers together. The first and second sets of yarns have a different affinity to a certain dye than does the third set of yarns. In one embodiment, when window shade 200 is exposed to the certain dye, the front and back layers will tend to incorporate the certain dye to a greater extent than will the intermediate layer. This differential affinity for a dye gives rise in part to a contrast between front layer 204, for example, and the exposed or revealed portions of intermediate layer 206, which enhances pattern 202.

The third set of yarns is generally of a dark color such that intermediate layer 206 is dark and limits light transmission therethrough. This limiting of light transmission is of course also contributed to by the front and back layers 204 and 208. However, the dark color of third set of yarns forming intermediate layer 206 effectively limits light transmission while contributing to pattern 202. In certain situations where less of a darkening effect is desired, other colors, shades, or textures of yarns may be used for the intermediate layer.

In one embodiment, the dyeing operation utilized for window shade 200 is pad dyeing. In this embodiment, the third set of yarns comprises solution dyed yarns that will not incorporate dye used in pad dyeing operations. The first and second sets of yarns do incorporate dye in pad dyeing operations. Thus, the front and back layers may be dyed a certain color in a pad dyeing operation while the intermediate layer will not accept the dye. This provides a contrast between front layer 204, at least, and the revealed portions of intermediate layer 206.

Figure 2:
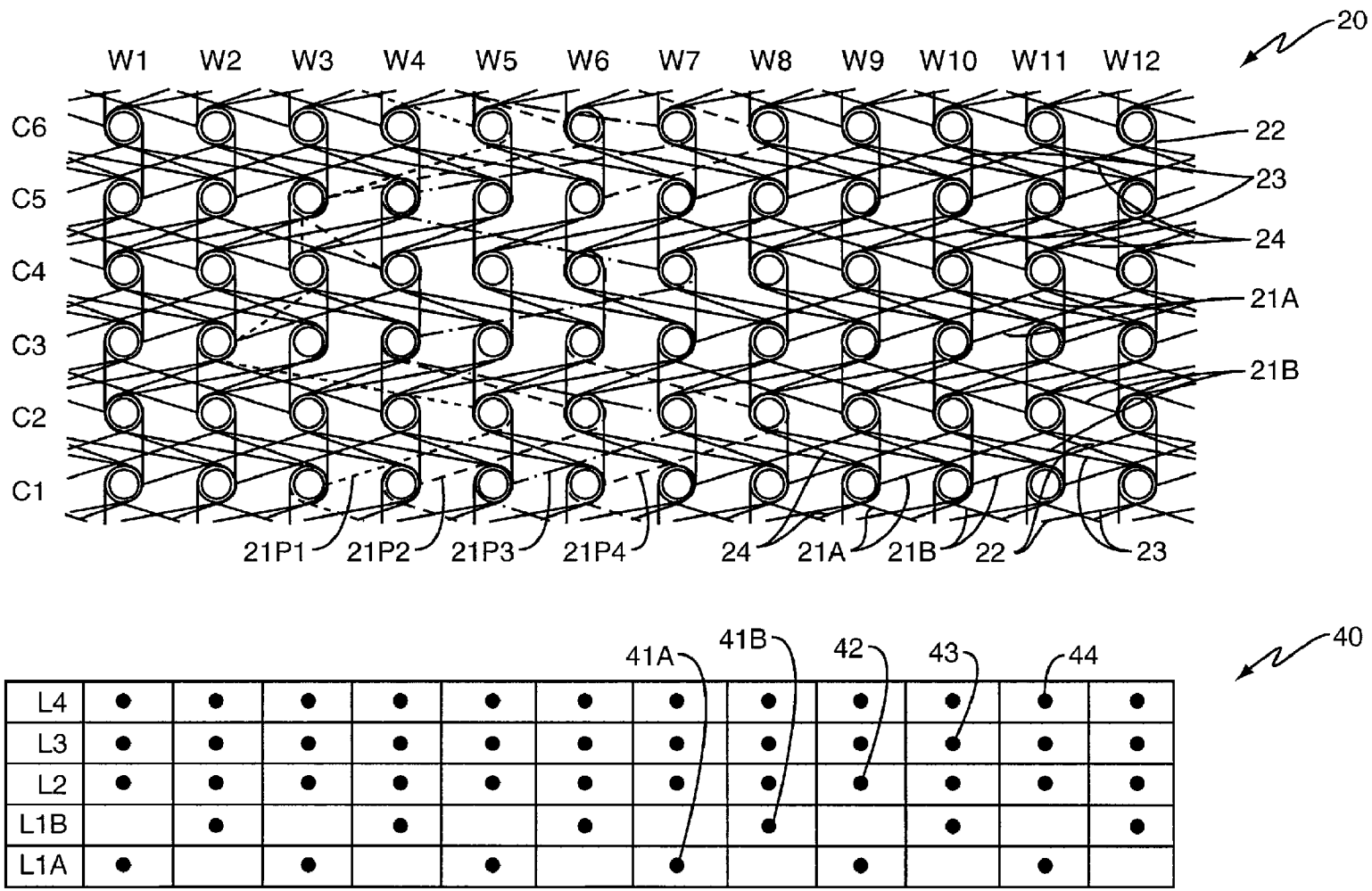
FIG. 2 is an threading chart and stitch construction for an example window shade formed on a Rascheltronic Single Jacquard machine.

In one embodiment, darker colors may be obtained by using jet dyeing as the dyeing operation for window shade 200. Jet dyeing inherently permits the use of darker colors. In a further embodiment, three colors can be obtained by employing cationic yarns in either the first set of yarns or second set of yarns of window shade 200 and by subsequently jet dyeing the window shade Turning now to a detailed description of the construction of window shade 200, FIG. 2 shows stitch construction 20 and threading chart 40 for forming window shade 200 on a single Jacquard Rascheltronic warp knitting machine. Stitch construction 20 displays a representative portion of window shade 200 that is 6 courses (C1-C6) long by 12 wales (W1-W12) wide. Each course in stitch construction 20 represents an instantaneous location of the needle array of the knitting machine, and each wale represents the sequence of locations of an individual needle in the array. Threading chart 40 depicts the guide bars having yarn guides to form stitches and inlays around needles in the knitting operation. In this embodiment, four guide bars are utilized. The frontmost bar is a Jacquard bar which is segmented into two sections, L1A and L1B. Ground bars L2, L3, and L4 are disposed in order behind the Jacquard. The bottom of chart 40 thus represents the front of the guide bars, and the top of the chart represents the back of the bars. Each bar includes a series of cells, 12 of which are shown in chart 40, and each cell represents one yarn guide on the bar. The yarn guides are spaced apart similarly to the needles in the needle array of the machine. Each guide, or cell on chart 40, may guide one or more yarns to engage one or more needles and form stitches or inlays. The stitches are formed by side shifting, or shogging, individual bars one or more needle positions to lap needles or loop needles in the array as it cycles in and out of the knitting area. This moves all guides in a given bar in unison. Additionally, the guides comprising the Jacquard bar may each be moved one needle position sideways in each direction independently of the other guides in the bar. This capability enables dynamically varying yarn placement to change the type of stitch of inlay produced by the yarn guided by a particular guide.

It is appreciated that typical warp knitting machines may have needle spacings—or machine gauges—of 9 needles per inch, 12, needles per inch, 18 needles per inch, etc. Actual fabrics are formed in composite sheets that may be up to 130 inches or more wide. Thus, stitch construction 20 and threading chart 40 represent a very small, but representative, portion of window shade 200.

Yarns may be supplied to the guides of the knitting machine from a single beam on which all yarns utilized are wound and/or from an array of individual spools, each spool wound with a single yarn. The individual spools are configured in a creel from which the yarns are directed to the appropriate guides of the knitting machine. Typically, beam feeding of yarns is appropriate for those for which the yarn consumption rate is fairly uniform. Creel fed yarns may have dynamically varying yarn consumption rates for the various yarns.

Turning now to the particular yarns utilized in forming window shade 200 on a Rascheltronic single Jacquard machine, yarns 41A and 41B are guided by Jacquard L1A, L1B. See FIG. 2. Segment L1A is half threaded, with a yarn 41A in every other guide. Segment L1B is also half threaded with a yarn 41B in every other guide and offset from the yarns 41A in segment L1A. Yarns 41A and 41B form the first set of yarns, which is utilized to form front layer 204 of non-laminated window shade 200. Yarns 44 are fully threaded in ground guide bar L4 and comprise the second set of yarns utilized to form back layer 208. Ground guide bar L3 is fully threaded with yarns 43 which comprise the third set of yarns used to form intermediate layer 206. Connecting yarns 42 are fully threaded in ground guide bar L2, and are used to connect layers 204, 206, and 208 in the knitting process. A selection of yarns appropriate for this embodiment is described in Table 1.

TABLE 1

| Guide Bar | Yarn Specification ply/denier/# filaments | Reference Numeral |
|---|---|---|
| L4 | 1/150/68 Textured Polyester | 44 |
| L3 | 1/150/34 Textured Solution Dyed Black Polyester | 43 |
| L2 | 1/40/24 Semi-Dull Flat Polyester | 42 |
| L1B | 1/70/34 Textured Polyester | 41B |
| L1A | 1/70/34 Textured Polyester | 41A |

Construction 20 illustrates representative portions of window shade 200 where intermediate layer 208 is not revealed as well as portions where the intermediate layer is revealed. The portions generally defined by courses C1-C6 between wales W7 and W12 represent portions where intermediate layer 208 is generally concealed by top layer 204. Courses C1-C6 between wales W2 and W7 illustrate representative portions of window shade 200 where intermediate layer 208 is exposed or revealed by yarns forming top layer 204 having been diverted. As discussed here before, pattern 202 is formed by the contrast between areas with exposed or revealed portions of intermediate layer 208 and areas where the intermediate layer is concealed behind front layer 204. Selectively concealing and exposing intermediate layer 208 is accomplished by dynamically adjusting the stitching done with yarns 41A and 41B which form front layer 204.

Turning now to a discussion of the construction of window shade 200 in portions where intermediate layer 206 is concealed, as mentioned here before top layer 204 effectively covers intermediate layer 206 in these portions. Yarns 41A and 41B form open tricot stitches 21A and 21B, respectively, spaced apart the distance between adjacent wales. Yarns 41A and 41B effectively zigzag along wales and form top layer 202. Yarns 43 and 44 form inlays 23 and 24, respectively with each inlay lapping from one wale in one course over one wale to a third wale in the next course. Inlays 23 thus form intermediate layer 206 while inlays 44 form back layer 208. Yarns 42 form open pillar stitches 22 running along each wale. Pillar stitches 22 bind the layers together by wrapping yarns of the respective layers where the yarns cross.

The construction of window shade 200 for portions where intermediate layer 206 is exposed or revealed differs from the above-described construction only insofar as the stitches formed by yarns 41A and 41B are concerned. In the areas where intermediate layer 206 is concealed, yarns 41A and 41B form identical and regularly-spaced open tricot stitches as described above. However, in areas where the intermediate layer is revealed yarns 41A and/or 41B are diverted to form different stitches which leave areas over the intermediate layer open. Examples of stitches formed by yarns 41A and 41B are illustrated as stitches 21P1, 21P2, 21P3, and 21P4. These particular yarns form stitches which are different from tricot stitches 21A and 21B by yarns of the same set in the areas where intermediate layer 206 is concealed. For example, stitch 21P1 is formed by a particular yarn 41A forming a tricot from C1-W3 to C2-W5, then to C3-W2 and then to C4-W3. From C4-W3 to C5-W3, yarn 41A forms an open pillar alongside pillar 22. Yarn 41A then forms a tricot from C5-W3 to C6-W5. Similar yarn trajectories form stitches 21P2, 21P3, and 21P4, and the result is that portions of yarns 43 forming intermediate layer 206 are exposed or revealed by the diversion of yarns 41A and 41B. These diversions, or stitch adjustments, are thus made dynamically, enabled by the piezo Jacquard.

Figure 3:
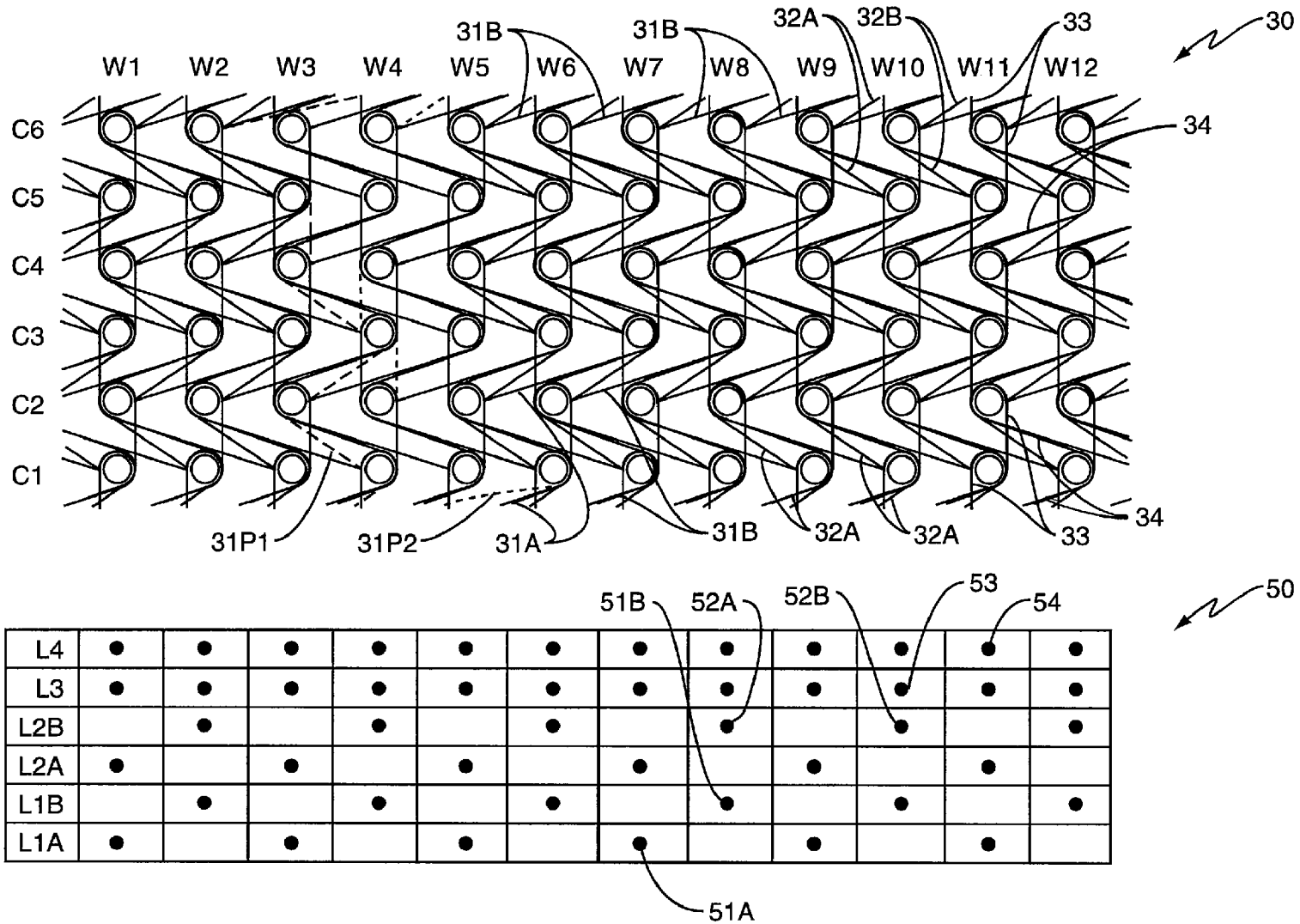
FIG. 3 is an example threading chart and stitch construction for an example window shade formed on a Double Jacquard machine.

In one embodiment, window shade 200 can be formed on a Double Jacquard knitting machine in accordance stitch construction 30 and threading chart 50 as shown in FIG. 3. It is appreciated that the machine utilizes two Jacquard bars. The front Jacquard bar is in two segments L1A, L1B and the back Jacquard is in two segments L2A, L2B. Behind the two Jacquards are, in order, ground bars L3 and L4.

Turning now to the particular yarns utilized in forming window shade 200 on a Double Jacquard machine, yarns 51A and 51B are guided by Jacquard L1A, L1B. See FIG. 3. Segment L1A is half threaded, with a yarn 51A in every other guide. Segment L1B is also half threaded with a yarn 51B in every other guide and offset from the yarns 51A in segment L1A. Yarns 51A and 51B form the first set of yarns, which is utilized to form front layer 204 of non-laminated window shade 200. Jacquard bar segment L2A is half threaded with yarns 52A and segment L2B is half threaded with yarns 52B, yarns 51A and 51B comprising the third set of yarns used to form intermediate layer 206. Yarns 54 are fully threaded in ground guide bar L4 and comprise the second set of yarns utilized to form back layer 208. Connecting yarns 52 are fully threaded in ground guide bar L2, and are used to connect layers 204, 206, and 208 in the knitting process. A selection of yarns appropriate for this embodiment is described in Table 2.

TABLE 2

| Guide Bar | Yarn Specification Ply/denier/# filaments | Reference Numeral |
|---|---|---|
| L4 | 1/150/68 Semi-Dull Texture Polyester | 54 |
| L3 | 70/34/56T Stretch Natural Semi-Dull Polyester | 53 |
| L2B | 1/150/34 Black Solution Dyed Polyester | 52B |
| L2A | 1/150/34 Black Solution Dyed Polyester | 52A |
| L1B | 1/300/68 Textured Polyester | 51B |
| L1A | 1/300/68 Textured Polyester | 51A |

Construction 30 illustrates a portion of window shade 200 having both non-patterned and patterned areas. For example, the area defined by courses C1-C6 and wales W7-W12 is a non-patterned area while the area defined by courses C1-C6 and wales W2-W6 is a patterned area were portions of intermediate layer 206 are exposed or revealed as will be further described. Selectively concealing and exposing intermediate layer 208 is accomplished by dynamically adjusting the stitching done with yarns 51A and 51B which form front layer 204. Adjusting the stitches formed by yarns 51A and 51B selectively reveals yarns 52A and 52B comprised in intermediate layer 206.

Turning now to a discussion of the construction of window shade 200 in portions where intermediate layer 206 is concealed in the embodiment illustrated in FIG. 3, as mentioned here before top layer 204 effectively covers intermediate layer 206 in these portions. Yarns 51A and 51B form open tricot stitches 31A and 31B, respectively, spaced apart the distance between adjacent wales. Stitches 31A and 31B effectively zigzag back and forth over three wales to form top layer 204. Yarns 52A and 52B form open tricot stitches 32A and 32B, zigzagging over two wales to form intermediate layer 206. Yarns 54 form inlays 34 lapping two wales to form back layer 208. Yarns 52 form open pillar stitches 32 running along each wale. Pillar stitches 52 bind the layers together by wrapping yarns of the respective layers where the yarns cross.

The construction of window shade 200 for portions where intermediate layer 206 is exposed or revealed differs from the above-described construction only insofar as the stitches formed by yarns 51A and 51B are concerned. In the areas where intermediate layer 206 is concealed, yarns 51A and 51B form identical and regularly-spaced open tricot stitches as described above. However, in areas where the intermediate layer is revealed yarns 51A and/or 51B are diverted to form different stitches which leave areas over the intermediate layer open. Examples of stitches formed by yarns 51A and 51B are illustrated as stitches 31P1 and 31P2. These particular yarns form stitches which are different from tricot stitches 31A and 31B by yarns of the same set in the areas where intermediate layer 206 is concealed. For example, stitch 31P1 is formed by a particular yarn 51A forming a tricot from C1-W4 to C2-W3, then to C3-W4 and then to C4-W3. From C4-W3 to C5-W3, yarn 51A forms an open pillar 31P1 alongside pillar 32. Yarn 51A then forms a tricot from C5-W3 to C6-W2. Similar yarn trajectories form stitches 31P2, and the result is that portions of yarns 52A and 52B forming intermediate layer 206 are exposed or revealed by the diversion of yarns 51A and 51B. These diversions, or stitch adjustments, are thus made dynamically, enabled by the Jacquard.

Turning now to dyeing window shade 200, the window shade is subjected to a dyeing operation to provide the desired coloration of the shade. In one embodiment as has been mentioned here before, a pad dyeing operation is used. In the pad dyeing operation, window shade 200 is conveyed through one or more vats, each containing a certain dye, and through a series of one or more padded rollers that squeeze out excess dye. The dye incorporates with the yarns comprising front layer 204 and back layer 208. However, the yarns comprising intermediate layer 206 have no affinity to the dye and do not incorporate the dye. In accordance with dye color selection, a contrast is then produced between any revealed portions of intermediate layer 206 and front layer 204 thereby producing a pattern. After the dyeing operation, window shade 200 is exposed to a heat setting oven prior to cutting. Heat setting bakes the color of the dye into the dyed portions of window shade 200.

Obtaining desired coloration may, in one embodiment, be achieved utilizing jet dyeing as mentioned here before. Jet dyeing inherently offers the capability of producing darker shades of color. Also, by selecting cationic yarns to form top layer 204, for example, one of ordinary skill in the art will appreciate that a three color window shade 200 can be provided. Jet dyeing may be preceded by a preliminary heat treatment to prevent shrinkage that is otherwise inherent in jet dyeing. After jet dyeing final framing is accomplished by a further heat setting operation.

As appreciated by one of ordinary skill in the art, window shade 200 is knitted in composite sheets that may then be cut to produce a number of window shades. These composite sheets would, in one embodiment, be 120-124 inches wide. The construction of non-laminated window shade 200 enables use of laser cutting to produce clean edges when cutting individual window shades from a composite sheet. Utilizing the same methodology for exposing or revealing portions of intermediate layer 206 to produce patterning on window shade 200, small bands demarking the edges of individual shades in the sheet are created. The edges of these bands serve to guide a laser cutting device to cut the individual window shades from the sheet. It is appreciated that these bands may be straight, as along vertical edges of a window shade 200, or they may be curved or jagged, as along a bottom edge of a shade to produce a desired decorative edge shape.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A window treatment for room darkening or dimming comprising:

a. a non-laminated window shade having integrally knitted front, back, and intermediate fabric layers;

b. the front fabric layer formed primarily by a first set of yarns;

c. the back fabric layer formed primarily by a second set of yarns;

d. the intermediate fabric layer formed primarily by a third set of yarns;

e. wherein the intermediate fabric layer in combination with one of both the front and back fabric layers substantially limits the transmission of light through the non-laminated window shade and f. wherein the front layer is configured to expose areas of the intermediate layer and wherein the exposed areas of the intermediate layer together with the front layer form a pattern.

2. The window treatment of claim 1 wherein the third set of yarns comprising the intermediate layer includes solution-dyed yarns.

3. The window treatment of claim 1 wherein the third set of yarns has a different affinity to a selected dye than do the first and second sets of yarns.

4. The window treatment of claim 1 wherein the front, back, and intermediate layers are interconnected by pillar stitches.

5. The window treatment of claim 1 wherein the intermediate layer is sandwiched between the front and back fabric layers.

6. The window treatment of claim 1 wherein the window shade fabric is adapted to be exposed to a dye and wherein one or both of the front and back fabric layers are adapted to substantially accept the dye while the intermediate layer is adapted to substantially reject the dye.

7. A method of forming a non-laminated window shade including:

a. selecting first, second, and third sets of yarns;

b. simultaneously knitting and connecting the first, second, and third sets of yarns to form front, back, and intermediate fabric layers;

c. forming the front fabric layer with relatively open areas and exposing portions of the intermediate fabric layer to form a pattern due to contrast between the front fabric layer and the intermediate fabric layer; and d. whereby the front, back, and intermediate fabric layers form the non-laminated window shade.

8. The method of claim 7 including connecting the front, back and intermediate layers of the window shade fabric by forming pillar stitches.

9. The method of claim 7 including selecting solution-dyed yarns for the third set of yarns.

10. The method of claim 9 including selecting the first and second sets of yarns such that each set of yarns has a different affinity for a selected dye from that of the other set of yarns.

11. The method of claim 7 including selecting a solution-dyed yarn for the third set of yarns and pad dyeing the window shade and producing a contrast between the front fabric layer and the intermediate fabric layer.

12. The method of claim 7 including forming the window shade into a composite sheet and laser cutting the composite sheet.

* * * * *